US005273477A

United States Patent [19]

Adams, Jr.

[11] Patent Number: 5,273,477

[45] Date of Patent: Dec. 28, 1993

[54] INFLATABLE INTERLOCKABLE BLOCKS FOR FORMING TOY STRUCTURES

[75] Inventor: George Adams, Jr., Orange, Calif.

[73] Assignee: The Lewis Trust, Longview, Wash.

[21] Appl. No.: 7,959

[22] Filed: Jan. 22, 1993

[51] Int. Cl.[5] ..... A63H 33/08; A63H 3/06

[52] U.S. Cl. ..... 446/108; 446/125; 446/127; 446/220

[58] Field of Search ..... 446/85, 89, 106, 108, 446/121, 125, 127, 220, 224

[56] References Cited

U.S. PATENT DOCUMENTS

| | | | |
|---|---|---|---|
| 850,889 | 4/1907 | Kelley | 446/127 X |
| 2,472,363 | 6/1949 | Blackinton | 446/127 |
| 2,731,768 | 1/1956 | Harrowe . | |
| 2,958,918 | 11/1960 | Mac Millan . | |
| 3,626,634 | 12/1971 | Jones et al. . | |
| 3,676,276 | 7/1972 | Hirshen et al. . | |
| 3,801,403 | 4/1974 | Lucek | 446/220 X |
| 3,994,102 | 11/1976 | Johnson et al. | 446/220 X |
| 4,007,555 | 2/1977 | Sasaoka | 446/127 |
| 4,197,681 | 4/1980 | Holcombe . | |
| 4,242,830 | 1/1981 | Hauser . | |
| 4,267,662 | 5/1981 | Gordy | 446/121 X |
| 5,145,440 | 9/1992 | Boris . | |

FOREIGN PATENT DOCUMENTS

| | | | |
|---|---|---|---|
| 2716090 | 10/1978 | Fed. Rep. of Germany | 446/125 |
| 2733708 | 2/1979 | Fed. Rep. of Germany | 446/85 |
| 990651 | 9/1951 | France | 446/125 |

*Primary Examiner*—David N. Muir

*Attorney, Agent, or Firm*—Fulwider Patton Lee & Utecht

[57] ABSTRACT

A plurality of like block components having edges formed with frictionally releasably interlocking tongues and grooves. The edges of adjoining block components are releasably interconnected to form a life size toy playhouse without the use of tools.

2 Claims, 2 Drawing Sheets

INFLATABLE INTERLOCKABLE BLOCKS FOR FORMING TOY STRUCTURES

BACKGROUND OF THE INVENTION

1. Field of Invention

This invention relates to toy structures capable of being readily erected by children. More specifically, the invention relates to novel building components for the construction of life size toy playhouses.

Among the most enjoyable pastimes for children is playing in life size toy structures. Conventional life size play structures are usually assembled from bulky, hard, heavy, cumbersome, and dangerous materials such as wood, cardboard, hard plastics or other materials not easily manipulated by children. Also, conventional life size play structures may require the use of tools, nails, adhesives or other fasteners to hold together the heavy elements from which these play structures are constructed which will require the supervision of an adult. The building components of conventional life size knock-down toy structures take up a large volume of space in relationship to the erected toy structure, and when the building components are stored, a voluminous area for their storage is required.

The present invention provides a safe, lightweight, easily stored and transported educational life size knockdown toy structure composed of self-interlocking inflatable block components, all of which can be assembled with relative ease in the construction of toy structures by children without the need of adult supervision.

2. Description of Prior Art

Life size toy structures are known in the prior art. U.S. Pat. No. 3,137,967 discloses a knockdown life size toy structure that is also a puzzle. U.S. Pat. No. 3,513,292 discloses a means of storing the bulky elements of a life size toy structure. U.S. Pat. Nos. 3,626,634; 3,676,276; 3,994,102 and 4,197,681 disclose a means of incorporating inflatable elements in the construction of life size play structures. U.S. Pat. No. 4,521,203 discloses a life size toy structure that addresses the problem of heavy building components in life size toy structures. U.S. Pat. No. 2,059,598 discloses a miniature log cabin construction toy. U.S. Pat. No. 4,877,044 discloses a means of releasably attaching a tent pole to a tent and to another tent pole. U.S. Pat. No. 5,145,440 discloses a knock-down life size toy structure for forming another type of miniature log cabin comprised of a plurality of simulated logs and a separate roof.

SUMMARY OF THE INVENTION

It is an object of the present invention to provide ease in manipulation of life size toy building components by children. The novel block components of this invention are inflatable and therefore easily manipulated by children because the components are made of a soft vinyl plastic material that is light in weight.

It is another object of this invention to provide a means of interlocking the inflatable block components one with another, so that a life size inflatable toy structure can be readily erected by children without the need for tools, fasteners, or adhesives. This object is accomplished through interlocking tongue and groove edge connections formed in along each edge of the blocks whereby the blocks can be interlocked for the construction of playhouse walls and roofs.

Another object of this invention is to provide for ease in storage and transportation of the disassembled life size toy structure. This object is accomplished because the blocks of the present invention are deflatable, thus, can be stored and transported in a relatively small space.

Another object of the present invention is to provide for a life size play structure that can be utilized safely indoors as well as outdoors. This object is accomplished by using inflatable light weight block components for the construction of the life size toy structure of the present invention.

Another object of the present invention is to help in the development of various intellectual traits of children. This object is accomplished due to childrens' ease in the manipulation of the light weight building block components, and the components' self interlocking features. Adult assistance and supervision is not required in the construction of the play structure according to the present invention, thereby allowing the child to build a variety of life size play structures, furthering the development of the childs' imagination, confidence and self esteem.

A more particular object of the present invention is to provide a block component which can be utilized with a plurality of similar block components to erect structures large enough to be played in by children with each block component being formed of a synthetic plastic material. The edges of each such block component has fastening surfaces which are releasably frictionally interlockable with complimentary fastening surfaces on the edges of similar blocks so that adjoining edges of a number of the blocks can be releasably interlocked to erect the toy structure. Each inflatable block component is provided with an air valve to inflate and deflate the block. One or more of such block components can be employed to form a roof for the toy structure thereby eliminating the need of providing a separate roof component.

DETAILED DESCRIPTION OF A PREFERRED EMBODIMENT OF THE INVENTION

Figure 1:
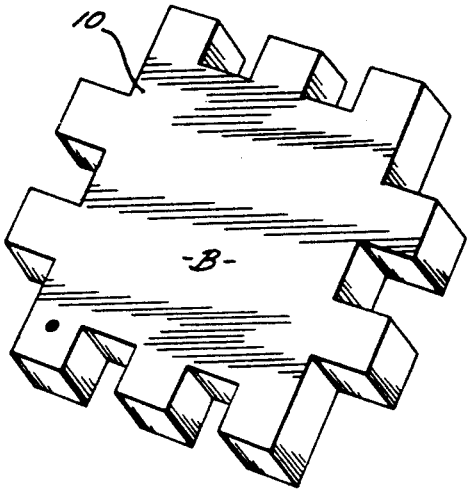
FIG. 1 is a perspective view showing an inflatable block component embodying the present invention.
Figure 2:
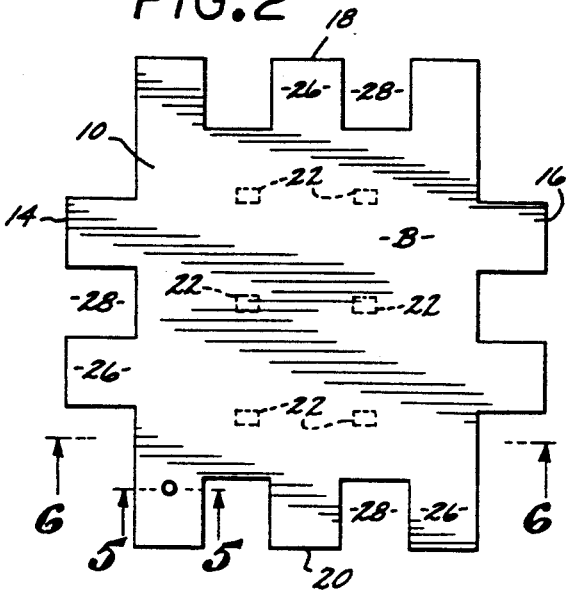
FIG. 2 is a side view of the inflatable block component of FIG. 1.
Figure 7:
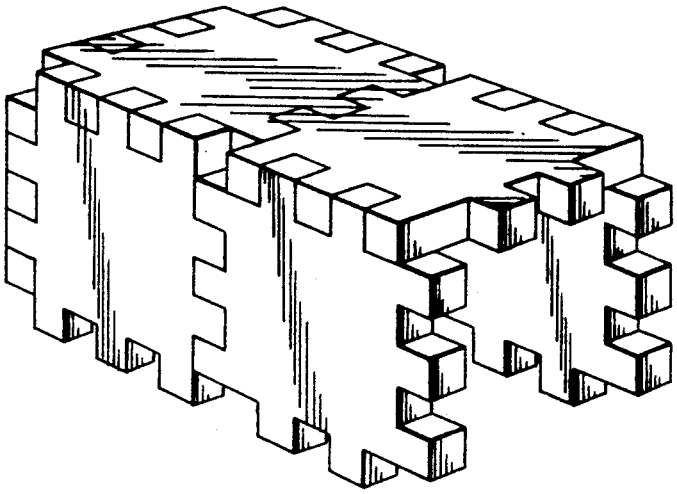
FIG. 7 is a perspective view showing one type of toy structure which may be formed by said block components.
Figure 8:
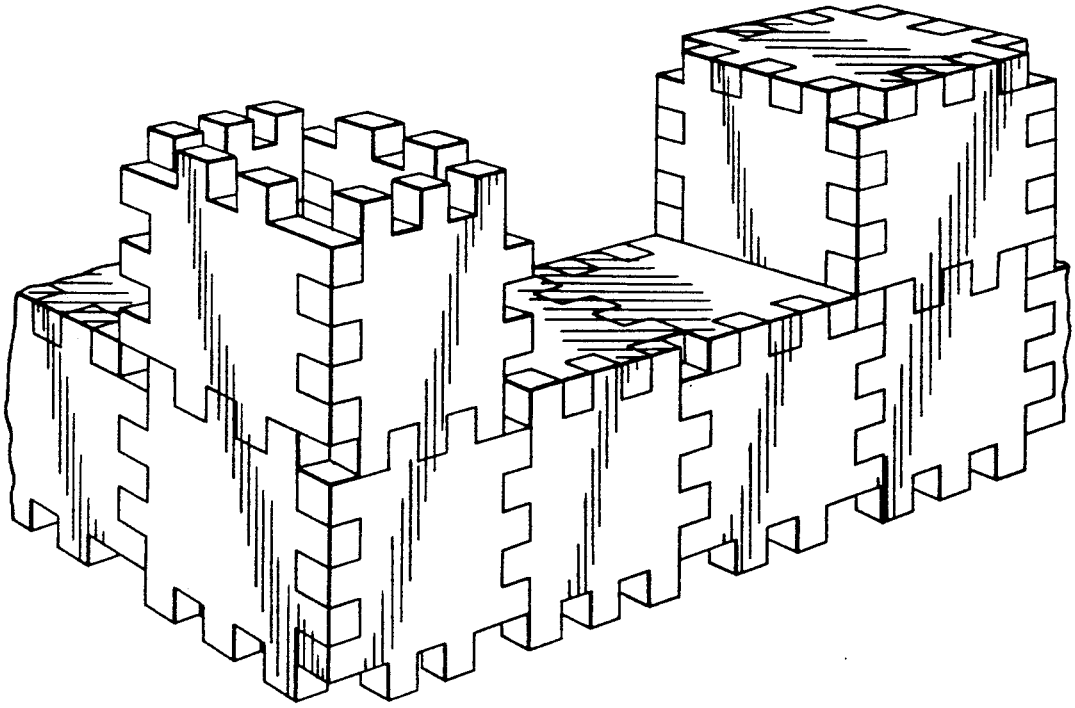
FIG. 8 is a perspective view of a more elaborate structure which may be formed by said block components.

Referring to the drawings, FIG. 1 is a perspective view showing an inflatable block component B embodying the present invention. The block B is preferably fabricated of a soft synthetic plastic, such as a vinyl, formed in a conventional manner utilizing overlapping seams (not shown) which are adhered together by dielectric heating or by a suitable adhesive in a well-known manner. Each block B is adapted to be utilized with a plurality of similar block components B to erect structures large enough to be played in by children. The edges of each block are formed with fastening surfaces which are releasably interlockable with complimentary fastening surfaces formed on the edges of the other similar block components. In this manner adjoining edges of a number of such block components can be releasably interlocked to erect structures such as shown in FIGS. 7 and 8. Such structures are used as life-size toy playhouses by children.

More particularly, each block component B is of a generally square outline in frontal view, having front and rear walls 10 and 12, respectively, interconnected by side-walls 14 and 16, and top and bottom walls 18 and 20, respectively. A plurality of webs 22 interconnect the front and rear walls 14 and 16 so as to restrain outward movement of such walls relative to one another. The front and rear of such webs are affixed to the inner surfaces of the front and rear walls as by dielectric heating or an adhesive. The side, top and bottom edges of the block components are of tongue and groove configuration, the tongues being designated 26 and the grooves being designated 28. These tongue and grooves are so dimensioned as to frictionally interfit with one another so as to be releasably interlockable with complimentary like tongue and grooves formed on the edges of a plurality of similar block components. With this arrangement, the adjoining edges of a number of such block components can be releasably interlocked to erect life-size toy structures.

Figure 5:
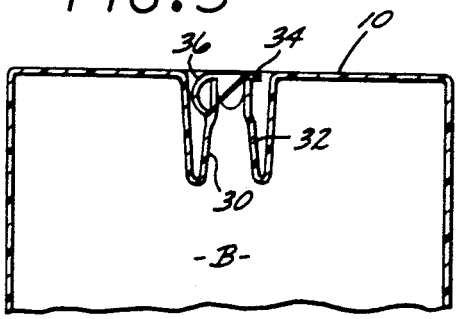
FIG. 5 is an enlarged sectional view taken along 5—5 of FIG. 2 showing an air valve element of said block component.
Figure 3:
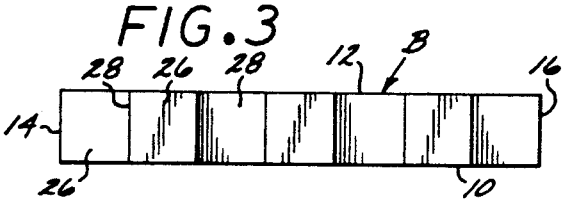
FIG. 3 is a top view of said block component.
Figure 4:
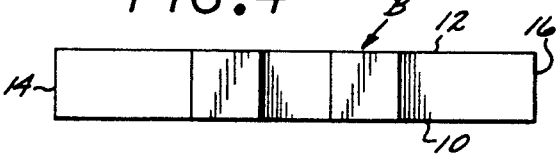
FIG. 4 is a side view of said block component.
Figure 6:
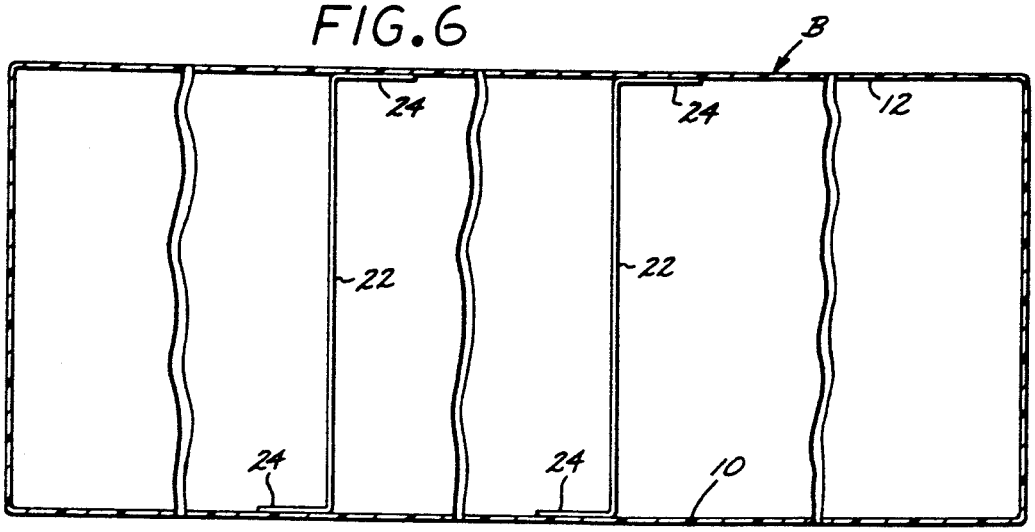
FIG. 6 is a sectional view taken in an enlarged scale along 6—6 of FIG. 3.

Referring to FIG. 5, the front wall 10 of each block is provided with a conventional air valve 30 which is integral with such front wall. The air valve 30 includes a filling tube 32 which receives a plug 34 retained to the intermediate portion of the tube by a flap 36. In order to inflate the block B, the tube 32 is pulled outwardly from the front wall 10, the cap 34 removed from the outer portion of the tube, and air is forced into the block as by human lung power. Alternatively, a conventional manual or electric-powered air pump (not shown) may be employed for this purpose. Thereafter, the cap 34 is re-inserted in the outer portion of the tube 32 and the tube is forced into the confines of the block B with the outer surface of the cap being substantially aligned with the outer surface of the front wall 10.

Referring now to FIG. 7, children can easily interlock the tongue and grooves of adjoining block components B so as to form life size toy structures, as for example, tunnels or caves such as shown in FIG. 7, or toy forts such as shown in FIG. 8. Because of the interlocking nature of the block components, the tunnels can be continuous, assume right angles or double-backs. It should be particularly noted that the structures can be formed with a roof by utilizing one or more of the block components B whereby a separate building component is not required to construct such roofs. Since the block components are fabricated from a soft synthetic plastic material, children can play with such components with no fear of injury. In this regard, the retractable nature of tube 32 and plug 34 eliminate inadvertent contact thereof by the child. Additionally, there are no small fastener elements subject to loss. It should also be noted, the block components can be manufactured at a low cost by mass production techniques.

When the toy structure is to be disassembled, the block components can be easily deflated by withdrawing the ca 34 from the tube 32. Thereafter, the deflated block components can be stored in a small area for future use.

Various modifications and changes may be made with respect to the foregoing detailed description without departing from the spirit of the present invention.

I claim:

1. A block component to be utilized with a plurality of similar block components to erect a structure large enough to be played in by children, said block component comprising:

an inflatable block fabricated of a soft synthetic plastic material, said blocks having front and rear walls integrally interconnected by side walls and the top and bottom walls;

a plurality of flat, horizontal, collapsible synthetic plastic webs interconnecting the front and rear walls so as to restrain outward movement of such walls relative to one another;

with the edges of the side, top and bottom walls defining like tongues and grooves which are so dimensioned so as to yieldably frictionally interfit with the complementary tongues and grooves on the edges of similar block components when such block components have been inflated, whereby the adjoining edges of a plurality of such block components can be releasably interlocked to erect life-size hollow toy structures without the use of tools; and an air valve carried by one of said walls to inflate and deflate such block component.

2. A block component as set forth in claim 1, wherein the air valve is retractably carried by one of said walls.

* * * * *

UNITED STATES PATENT AND TRADEMARK OFFICE

CERTIFICATE OF CORRECTION

PATENT NO. : 5,273,477

DATED : December 28, 1993

INVENTOR(S) : George Adams, Jr.

It is certified that error appears in the above-identified patent and that said Letters Patent is hereby corrected as shown below:

Column 4, line 18, delete [ca] should read --cap--

Signed and Sealed this

Twenty-fourth Day of May, 1994

*Attest:*

Bruce Lehman

BRUCE LEHMAN

*Attesting Officer*

*Commissioner of Patents and Trademarks*